US012544679B2

(12) United States Patent
Xue

(10) Patent No.: US 12,544,679 B2
(45) Date of Patent: Feb. 10, 2026

(54) PULL-BACK OR WIND-UP MODEL CAR CAPABLE OF TRAVELLING ON AT LEAST TWO DIFFERENT PATHS

(71) Applicant: Hua Xue, Shenzhen (CN)

(72) Inventor: Hua Xue, Shenzhen (CN)

(73) Assignee: Hua Xue, Shenzhen (CN)

( * ) Notice: Subject to any disclaimer, the term of this patent is extended or adjusted under 35 U.S.C. 154(b) by 924 days.

(21) Appl. No.: 17/830,436

(22) Filed: Jun. 2, 2022

(65) Prior Publication Data

US 2022/0297019 A1 Sep. 22, 2022

Related U.S. Application Data

(63) Continuation-in-part of application No. 17/060,151, filed on Oct. 1, 2020, now Pat. No. 11,452,947.

(51) Int. Cl.

| | |
|---|---|
| ***A63H 17/36*** | (2006.01) |
| ***A63H 17/26*** | (2006.01) |
| ***A63H 29/02*** | (2006.01) |

(52) U.S. Cl.

CPC ..... *A63H 17/36* (2013.01); *A63H 17/262* (2013.01); *A63H 29/02* (2013.01)

(58) Field of Classification Search

CPC ..... A63H 17/26; A63H 17/262; A63H 17/36; A63H 17/38; A63H 29/02

USPC ..... 446/436, 437, 460, 464, 465, 468, 486

See application file for complete search history.

(56) References Cited

U.S. PATENT DOCUMENTS 1,643,903 A * 9/1927 Prosser ..... A63H 29/04 446/442
1,756,539 A * 4/1930 De Filippis ..... A63H 17/395 446/436
2,172,416 A * 9/1939 Swenson ..... A63H 17/06 74/440
2,421,041 A * 5/1947 Swenson ..... A63H 17/395 446/436

(Continued)

FOREIGN PATENT DOCUMENTS

CN 203989854 U 12/2014
CN 110152317 U 8/2019

(Continued)

OTHER PUBLICATIONS

English language Abstract of CN203989854U.
English language Abstract of CN110152317U.

*Primary Examiner* — Alexander R Niconovich
(74) *Attorney, Agent, or Firm* — William J. Barber; WARE FRESSOLA MAGUIRE & BARBER LLP

(57) ABSTRACT

A model car has a car chassis having at least three wheels, a steerable wheel and a steering gear, a spring mechanism that stores energy used to steer the steerable wheel, and a coupling/decoupling mechanism arranged between the spring mechanism and the steering gear. The steering gear has an input gear wheel connected to the spring mechanism, an output gear wheel connected to the steerable wheel, and two intermediate gear wheel paths each comprising an intermediate gear wheel providing an connection between the input and output gear wheels on alternative intermediate gear wheel paths, and the input gear wheel is movable by the coupling/decoupling mechanism to mesh with at least two of the intermediate gear wheels.

12 Claims, 8 Drawing Sheets

(56) References Cited

U.S. PATENT DOCUMENTS 2,729,026 A * 1/1956 Slaby ..... A63H 29/04 446/436
2,775,848 A * 1/1957 Isaacson ..... A63H 17/395 200/37 R
3,252,247 A * 5/1966 Miller ..... A63H 17/36 180/204
3,482,352 A * 12/1969 Heim ..... A63H 17/395 446/436
4,077,156 A * 3/1978 Asano ..... A63H 29/02 446/464
4,241,534 A * 12/1980 Larsson ..... A63H 31/00 192/48.92
4,254,577 A * 3/1981 Cheng ..... A63H 18/16 104/304
4,453,712 A * 6/1984 Lee ..... A63H 18/12 104/304
4,463,519 A * 8/1984 Hayes ..... A63H 29/02 446/443
4,485,587 A * 12/1984 Barlow ..... A63H 17/40 446/442
4,488,375 A * 12/1984 Cheng ..... A63H 17/262 446/470
4,786,269 A * 11/1988 Nagel ..... A63H 31/00 446/464
4,836,819 A * 6/1989 Oishi ..... A63H 11/10 446/353
6,371,830 B1 * 4/2002 Wu ..... A63H 17/262 446/457
9,387,411 B1 * 7/2016 Thompson ..... A63H 17/262
9,579,585 B2 2/2017 Silverglate et al.
11,452,947 B2 * 9/2022 Xue ..... A63H 17/262
2011/0104982 A1 5/2011 Koehl
2019/0336873 A1 11/2019 Kwan

FOREIGN PATENT DOCUMENTS

GB 1327257 A * 8/1973 ..... A63H 17/395
GB 2057897 A * 4/1981 ..... A63H 18/14
GB 2181066 A * 4/1987 ..... A63H 17/395

* cited by examiner

PULL-BACK OR WIND-UP MODEL CAR CAPABLE OF TRAVELLING ON AT LEAST TWO DIFFERENT PATHS

CROSS-REFERENCE TO RELATED APPLICATIONS

This application is a continuation-in-part of, and claims benefit to, U.S. application Ser. No. 17/060,151, filed on 1 Oct. 2020, which is hereby incorporated by reference in their entirety.

TECHNICAL FIELD

The invention relates to the technical field of model car devices, in particular to a pull-back or a wind-up model car. The model car is configured to travel on at least two different paths comprising one path and at least one other path. The at least two different paths comprise at least two of a straight line and any kind of a curved line. The curved line may comprise an S-shaped path, a path shaped in the form of an 8 (number eight) or any other kind of curved path.

BACKGROUND OF THE PRESENT INVENTION

Such a model car usually drives at least one of the rear wheels to rotate via a spring mechanism so that propulsion of the model car is achieved due to the energy stored in the spring mechanism. The spring mechanism comprises at least one spring element that can be tensioned before the model car is operated. The spring mechanism is preferably directly or indirectly (i.e. by means of a spring mechanism housing or any other component) attached to the chassis of the model car. The spring element comprises, for example, a coil spring, a rubber band or the like. The spring mechanism of a pull-back model car can be tensioned by pulling back the model car standing on a surface. In doing so, the driven wheels of the model car are turned against the direction of propulsion and tension the spring element. Alternatively, in a wind-up model car, the spring mechanism may be tensioned by winding up the spring element by means of a lever or a key while preventing the rotation of the at least one driven wheel.

The known pull-back and wind-up model cars usually drive only on straight tracks. Steering of the wheels, especially the front wheels, is not provided. At most, it is possible to set steerable front wheels to a certain steering angle in advance, so that the model car does not run on a straight track, but on a circular track. The steering angle determines the radius of the circular track. The result is that the known model cars are not very close to reality.

Therefore, a model car capable of travelling on straight lines as well as on different curved lines is urgently needed.

SUMMARY OF PRESENT INVENTION

The object of the invention is to provide for a model car capable of travelling on at least two different paths. A further object is to provide for fast and easy switching of the model car between different travelling paths.

In order to achieve the above object, the invention suggests the following technical solution: A model car configured to travel on at least two different paths comprising one path and at least one other path, the model car comprising a car chassis having at least three wheels rotatably mounted thereto and a tensionable spring mechanism in a rotary connection to at least one of said wheels for driving said at least one wheel, wherein the energy stored in said tensioned spring mechanism is used to drive said at least one drivable wheel and to propel said model car standing on a surface, at least one of said wheels embodied as a steerable wheel articulated in respect to the car chassis about a steering axis, wherein articulation of the at least one steerable wheel is effected by means of a steering gear, a deflection mechanism which is operatively connected to the spring mechanism in such a way that part of the energy stored in the tensioned spring mechanism is used to steer the at least one steerable wheel during propulsion of the model car, and a coupling/decoupling mechanism from outside the model car, functionally arranged between the spring mechanism and the steering gear and configured to switch a steering function of the at least one steerable wheel thereby switching travel of the model car between the one path and the at least one other path.

The at least two different paths may comprise a straight path and at least one curved path or alternatively, at least two curved paths. Thus, travelling of the model car can be switched between a straight path and at least one curved path. Alternatively, travelling of the model car can be switched between at least two different curved paths. In the latter case, they may be no possibility for the model car to alternatively travel on a straight path.

Preferably, the at least two different paths comprise a straight path and at least one curved path and wherein the coupling/decoupling mechanism is configured to deactivate or activate a steering function of the at least one steerable wheel.

The model car according to the invention can travel on a straight path or alternatively on one or more different curved paths during propulsion. When travelling on curved paths, the model car can perform variable cornering. In particular, the radius and/or direction of the curved path may vary dynamically during propulsion of the model car. In this way, the model car can execute an S-shaped, an 8-shaped, a circular path with dynamically varying radius or any other path during propulsion. The start and end points of the path do not have to coincide. Of course, the mentioned paths do not have to be followed with high precision. Rather, it is sufficient if the paths are followed approximately. By travelling on curved paths, the model car can be operated in smaller spaces, in particular inside relatively small rooms. If the model car travels on a straight path, it requires a rather long, and possibly also large, space for travelling the entire straight path corresponding to the positional energy stored in the tensioned spring mechanism.

The deflection mechanism comprises one or more deflection gear wheels and is configured to divert part of the energy stored in the tensioned spring mechanism for use for steering the at least one steerable wheel of the model car. In particular, the deflection mechanism—possibly in connection with the steering gear—is configured to convert part of the energy stored in the tensioned spring mechanism into a rotational movement which is used to steer the at least one steerable wheel of the model car. Furthermore, the steering gear is configured to convert the rotational movement of an output wheel of the deflections mechanism into an approximately linear steering movement of the at least one steerable wheel. The direction of the steering movement is preferably perpendicular to the direction of travel of the model car during propulsion when travelling straight ahead, perpendicular to a longitudinal extension and parallel to the axis of rotation of the driven wheels. Preferably, the steering angle of the at least one articulated steerable wheel varies dynamically in magnitude and/or direction during propulsion of the model car, when the deflections mechanism and the steering gear are active. The steering movement does not have to be symmetrical to the direction of travel of the model car when driving straight ahead, but can also be asymmetrical to it. In this case, the model car would deflect more strongly or more often to one side than to the other side. Preferably, the steering movement of the at least one steered wheel repeats periodically. In total, the steerable model car can thus cover a distance where the starting point and the end point—after any cornering in between—are approximately the same.

Advantageously, the model car according to the invention has a vehicle body which is attached to the chassis, preferably in a detachable manner. In particular, a snap-in or clamp connection between the body and the chassis is envisaged so that the body can be attached and detached without tools. The body may be made of plastic, metal or any other material. The body is preferably similar in appearance to the vehicle body of a real motor vehicle. Thus, the model car can be used as an advertising medium of a car manufacturer. It is also conceivable that the body is provided with an advertising imprint on the outside so that the model car can be used as an advertising medium for any company. The body can be that of a passenger car, a truck, a bus, a delivery van or any other type of motor vehicle. Thus, the term "car" in the sense of the invention comprises passenger cars of any type (e.g. limousines, station wagons, SUVs, vans, convertibles), trucks and busses.

Preferably, the spring mechanism forms a unit with a pivot axis of the one or more drivable wheels. In particular, one or more rear wheels of the model car constitute the drivable wheels. In this case, the axis of rotation of the rear wheels is rotatably mounted on or in a housing of the spring mechanism. The rear wheels are fixed to the axis of rotation in a rotationally fixed manner. The housing of the spring mechanism is attached to the chassis of the model car. The vehicle body may be attached to the housing of the spring mechanism or to the chassis. The rear wheels protrude into corresponding recesses or wheel housings of the vehicle body. The spring element is located inside the housing. One proximal end of the spring element is attached to the housing while the other distal end of the spring element is attached to the pivot axle. The spring element is preferably a spiral spring wound up in one plane.

Alternatively, the spring mechanism has an intermediate rotatable axle to which the distal end of the spring element is attached. The intermediate axle protrudes from the housing and is non-rotatably connected to a gear wheel which is arranged outside the housing. This gear wheel engages with another gear wheel directly or indirectly via at least one further gear wheel, the other gear wheel being non-rotatably mounted on the axis of rotation of the one or more rear wheels. In this way, a transmission or reduction can be achieved between the intermediate axle or the unwinding of the spring element due to the energy stored therein and the driven (rear) axle of the model car.

The coupling/decoupling mechanism operable from outside the model car is provided functionally between the spring mechanism and the steering gear. By operating the coupling/decoupling mechanism the steering function of the one or more steerable wheels can be activated or deactivated during propulsion of the model car. When the steering function is deactivated, the model car according to the invention can drive in a normal straight line or on a fixed pre-set circular path. When the steering function is activated, the model car travels along a possibly dynamically varying curved path during propulsion as described above. The coupling/decoupling mechanism establishes or interrupts the active functional connection between the spring mechanism and the steering gear. Thus, the coupling/decoupling mechanism can act on the spring mechanism or a part thereof, on the deflection mechanism or a part thereof and/or on the steering gear or a part thereof. The coupling/decoupling mechanism can be operated from outside the model car by a user, preferably manually, i.e. from outside the vehicle chassis and/or from outside the mounted vehicle body.

When the steering function is deactivated, the coupling/decoupling mechanism can, for example, separate an input gear wheel of the steering gear from an output gear wheel of the steering gear, so that they are no longer in mutual engagement (i.e. do no longer mesh) and the continuous rotational movement of the deflection mechanism is no longer transmitted to the steering gear.

Alternatively, when the steering function is deactivated, it would be conceivable to separate a gear wheel of the deflection mechanism from a gear wheel of the spring mechanism that previously was in mesh with the gear wheel of the deflection mechanism. These gear wheels may be located on the outside of the housing of the spring mechanism and driven by the latter. After separation of the gear wheels they are no longer in mutual engagement. Although the steering function is deactivated, the energy stored in the spring mechanism and the resulting continuous rotational movement of the spring mechanism are still transmitted to the axis of rotation of the driven wheels to realize propulsion of the model car. However, the energy stored and the continuous rotational movement are no longer transmitted to the deflection mechanism and thus to the steerable wheels. The active connection between the spring mechanism and the steering gear can also be interrupted or restored by the coupling/decoupling mechanism at any other point in the deflection mechanism or the steering gear.

The steering gear or the steerable wheels are preferably provided with a return mechanism that holds the steerable wheels in a predefined steering angle, preferably in a straight-ahead position, by means of spring force. For instance, the return mechanism may comprise a leaf spring or the like. The steerable wheels are articulated against the spring force of the return mechanism. This ensures that the steerable wheels are aligned in the predefined steering angle, preferably straight ahead, when the steering function is deactivated or when there is no articulation of the steerable wheels for other reasons.

Several steerable wheels are preferably linked by means of a steering linkage to ensure that all steerable wheels are articulated at predetermined times in a corresponding direction and by corresponding steering angles. In addition, the steerable wheels can be articulated by moving the steering linkage alone; separate control and articulation of all steerable wheels is not necessary. The steering linkage can be articulated to the steerable wheels in such a way that when travelling on a curved path, an inner wheel is articulated in the direction of the curved path by a larger extent than an outer wheel.

The steering axes of the steerable wheels preferably run in a vertical direction, but do not have to be exactly perpendicular to the surface on which the model car is standing, but can also have a slight inclination inwards (towards the car) or outwards (away from the car) as well as forwards or backwards (details in each case in relation to the direction of travel of the model car). The steering axes do not necessarily have to be perpendicular to the axis or axes of rotation of the steerable wheels.

According to a preferred embodiment, the curved path comprises at least one of an S-line path and a path in the form of an 8. Of course, the curved path may comprise other types of curve forms, too. The curved paths are preferably symmetrical in respect to the straight path, on which the model car can also travel, i.e. the amount by which the curved path runs on the right of the straight path corresponds to the amount by which—possibly after running on the right—the curved path runs on the left of the straight path. To this end, the model car can travel on the S-line path and on a path in the form of an 8. However, it is also conceivable that the curved paths are asymmetrical in respect to the straight path.

Preferably, the curved path comprises an S-line path and a path in the form of an 8, and wherein the coupling/decoupling mechanism is configured to switch travel of the model car to one of a straight line, an S-line path and a path in the form of an 8.

Preferably, the model car is designed as a pull-back model car or a wind-up model car. The spring mechanism of a pull-back model car can be tensioned by pulling back the model car standing on a surface. In doing so, the driven wheels of the model car are turned against the direction of propulsion and tension the spring element. Alternatively, in a wind-up model car, the spring mechanism may be tensioned by pulling up the spring element by means of a lever or a key while preventing the rotation of the at least one driven wheel.

According to a preferred embodiment of the invention, the steering gear is switchable between a first configuration in which the at least one steerable wheel is not articulated about the steering axis so as to make the model car travel on a straight path and at least one second configuration in which the at least one steerable wheel is articulated so as to make the model car travel on a curved path. When the at least one steerable wheel is not articulated, it is preferably held in a predefined steering angle by means of a return mechanism, for example in the form of a leaf spring or the like.

Preferably, the coupling/decoupling mechanism is configured to switch the steering gear between the different configurations. Thus, by actuating the coupling/decoupling mechanism the steering gear can be switched, in order to make the model car travel on a straight path or on a curved path.

Preferably, the second configuration comprises a first sub-configuration in which the at least one steerable wheel is articulated so as to make the model car travel on an S-line path and a second sub-configuration in which the at least one steerable wheel is articulated so as to make the model car travel on a path having the form of an 8.

Preferably, the coupling/decoupling mechanism is configured to switch the steering gear between the different configurations and sub-configurations. Thus, by actuating the coupling/decoupling mechanism the steering gear can be switched, in order to make the model car travel on an S-line path or on a path having the form of an 8. Particularly preferable, the coupling/decoupling mechanism is configured so as to switch the steering gear, in order to make the model car travel on a straight path, an S-line path or on a path having the form of an 8

According to yet another preferred embodiment of the invention, the steering gear comprises a plurality of gear wheels including an input gear wheel operatively connected to the spring mechanism, an output gear wheel operatively connected to the at least one steerable wheel, and two intermediate gear wheel paths each comprising at least on intermediate gear wheel providing an operative connection between the input gear wheel and the output gear wheel on alternative intermediate gear wheel paths, and wherein the input gear wheel is movable by means of the coupling/decoupling mechanism, in order to selectively mesh with an intermediate gear wheel of the first intermediate gear wheel path, with an intermediate gear wheel of the second intermediate gear wheel path, or with no intermediate gear wheel.

For instance, when the input gear wheel meshes with an intermediate gear wheel of the first intermediate gear wheel path, the model car may be made to travel on an S-shaped path, when the input gear wheel meshes with an intermediate gear wheel of the second intermediate gear wheel path, the model car may be made to travel on an 8-shaped path, and when the input gear wheel meshes with none of the intermediate gear wheels, the model car may be made to travel on a straight path.

Of course, other embodiments of the steering gear are also conceivable. For instance, when the input gear wheel meshes with an intermediate gear wheel of the first intermediate gear wheel path, the model car may be made to travel on a straight path, when the input gear wheel meshes with an intermediate gear wheel of the second intermediate gear wheel path, the model car may be made to travel on an S-shaped path, and when the input gear wheel meshes with none of the intermediate gear wheels, the model car may be made to travel on an 8-shaped path.

It is suggested that the input gear wheel comprises two coaxially arranged pinions with different numbers of teeth fixed to each other so that they cannot rotate in respect to each other about a rotational axis of the input gear wheel, wherein a first pinion of the input gear wheel is configured to mesh with the intermediate gear wheel of the first intermediate gear wheel path and a second pinion of the input gear wheel is configured to mesh with the intermediate gear wheel of the second intermediate gear wheel path.

This can have the effect that the steering speed, i.e. the rate of change of the model car's direction, is different when travelling on an S-shaped path than when travelling on an 8-shaped path.

Finally, it is suggested that the output gear wheel of the steering gear eccentrically drives a steering linkage which is articulated to the at least one steerable wheel. Preferably, the model car comprises a total of four wheels, wherein the two front wheels are steerable and the two rear wheels are the driven wheels.

The steering linkage connects the two steerable wheels and provides for contemporary articulation of both front wheels. Continuous rotation of the output gear wheel in a given direction preferably provokes a continuous back and forth movement of the steering linkage (preferably in a direction approximately perpendicular to the longitudinal extension of the model car) and consequently to a continuously repeating left and right articulation of the steerable wheels. Depending on how long the articulation of the steerable wheels in a given direction lasts, the model car will travel on an S-shaped path, on an 8-shaped path or on any other kind of curved path.

DETAILED DESCRIPTION OF PREFERRED EMBODIMENTS

Figure 1:
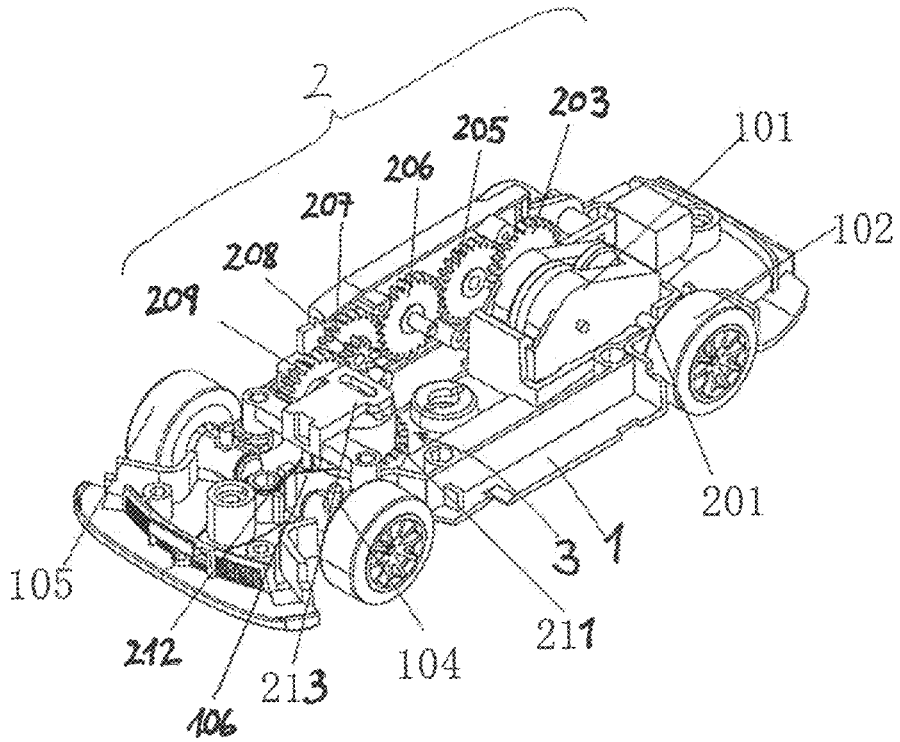
FIG. 1 is a perspective view on a first embodiment of the model car according to a first embodiment of the present invention, with a vehicle body separated from a vehicle chassis.

The present invention relates to a pull-back model car or wind-up model car. The model car comprises a vehicle chassis 1 (cf. FIG. 2) with at least three wheels 102, 105 rotatably mounted thereto. In the illustrated embodiments, the model car has four wheels, two driven rear wheels 102 and two steerable front wheels 105. Preferably, the model car also comprises a vehicle body (not shown) which is directly or indirectly attached to the chassis 1, preferably in a detachable manner. The bodywork is preferably similar in appearance to the bodywork of a real motor vehicle. Both the chassis 1 and the body may be made of metal and/or plastic or any other suitable material.

Furthermore, the model car comprises a tensionable spring mechanism 101 (cf. FIG. 1) which is in rotational connection with at least one of the driven wheels. In the present case, the spring mechanism 101 is in rotational connection with both rear wheels 102 via a rotational axis 201 to drive them. The energy stored in the tensioned spring mechanism 101 is used to drive the driven wheels 102 and to propel the model car while standing on a surface.

Figure 2:
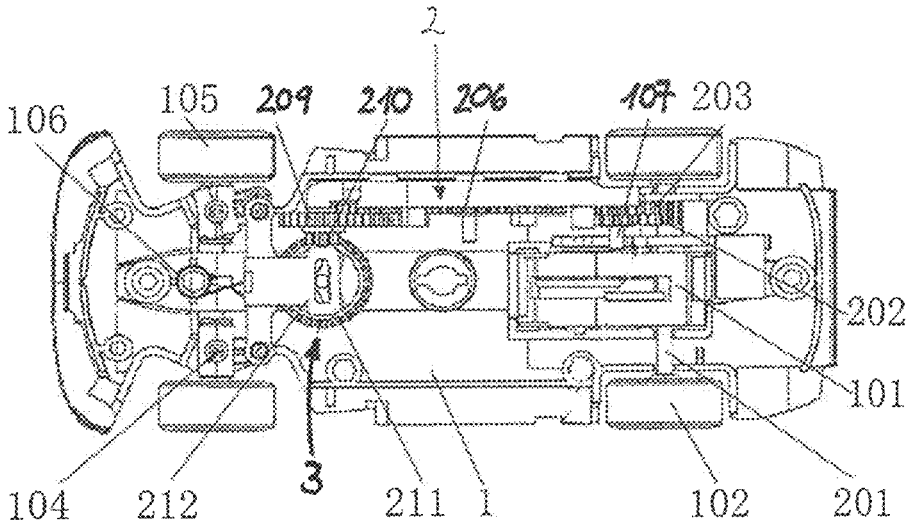
FIG. 2 is a top view on the model car of FIG. 1.
Figure 3A:
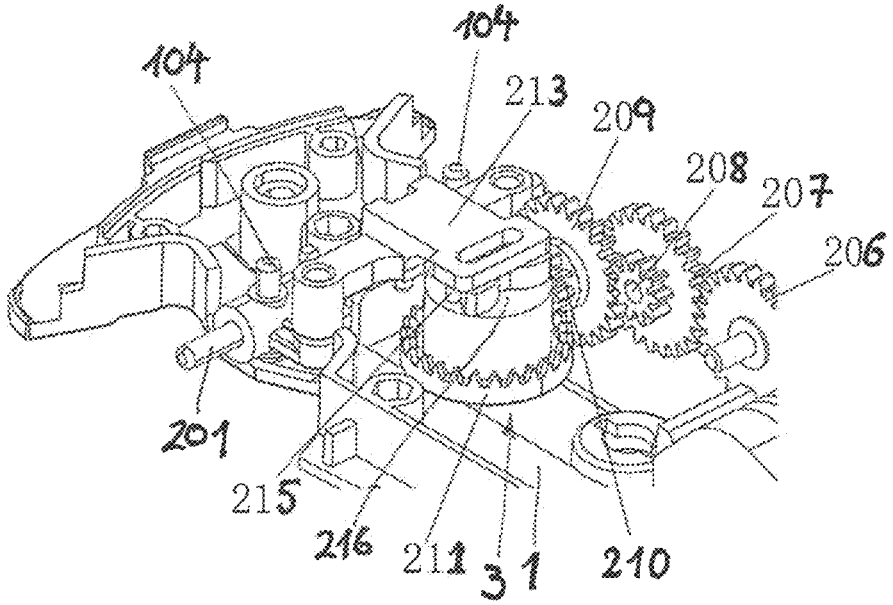
FIGS. 3A and 3B are perspective views from different angles on a front part of the model car of FIG. 1.
Figure 3B:
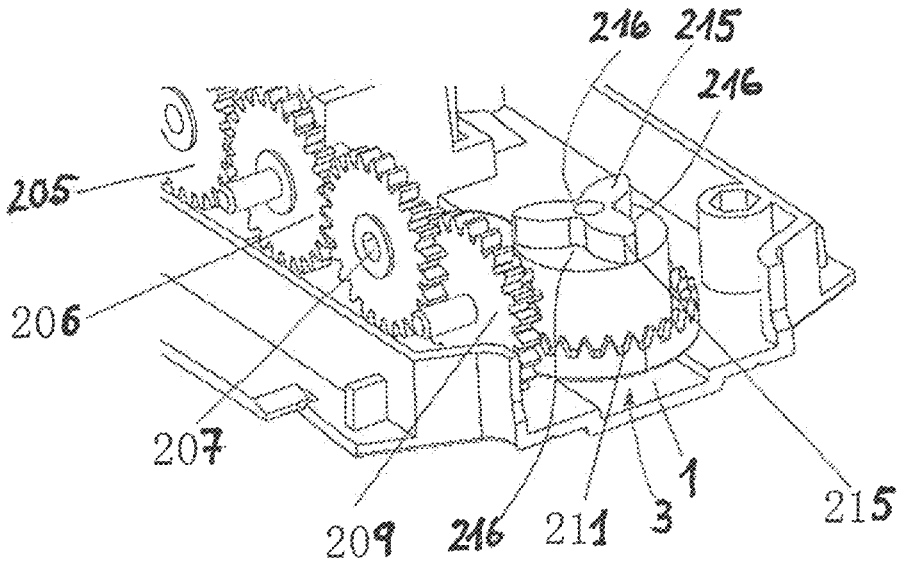

The spring mechanism 101 comprises at least one spring element (not shown) which is tensioned prior to operation of the model car in order to store positional energy therein. The spring element comprises, for example, a coil spring, a rubber band or the like. Further, the spring mechanism may include a flywheel to provide more uniform propulsion of the model car. The spring mechanism 101 may—as in the shown embodiments—be effected by pulling back the model car standing on the surface against the propulsion direction. In this case, the driven wheels 102 of the model car are turned backwards against the direction of propulsion and tension the spring element. In FIGS. 1 and 2, the winding mechanism is an integral part of the spring mechanism 101 and is arranged in a common housing with the latter. Alternatively, the spring mechanism 101 can also be tensioned by winding up by means of a lever or a key (not shown) with simultaneous prevention of rotation of the driven wheels 102. For example, the wheels 102 may be held in place by hand when the spring mechanism 101 is wound up and released when the model car is placed on the surface.

The invention proposes a pull-back and wind-up model car comprising

- a deflection mechanism 2 which is operatively connected to the spring mechanism 101 in such a way that part of the energy stored in the tensioned spring mechanism 101 can be used to steer the at least one steerable wheel 105 during propulsion of the model car, and
- a coupling/decoupling mechanism 217 operable from outside the model car, functionally arranged between the spring mechanism 101 and the steering gear 3 and configured to deactivate or activate a steering function of the at least one steerable wheel 105, switching travel of the model car to one of a straight path and a curved path.

The model car according to the invention can thus perform variable cornering during propulsion. In particular, the radius and/or direction of the curved travel path varies dynamically during propulsion of the model car. In this way, the model car can execute an S-shaped, an 8-shaped, a circular path, each with a constant or with a dynamically varying radius, and/or any other path during propulsion. In particular, the start and end points of the curved path do not have to coincide.

The deflection mechanism 2 comprises one or more deflection gear wheels 203-209. The mechanism 2 is designed to convert part of the energy stored in the tensioned spring mechanism 101 into a preferably continuous and uniform rotary movement, for example of an output wheel 209, which is used to steer the steerable wheels 105 of the model car. Furthermore, the deflection mechanism 2 operates the steering gear 3 which converts the rotary motion of at least one of the deflection gear wheels 203-209 into a steering motion of the steerable wheels 105 about the steering axes 104. The wheels 105 are preferably articulated in a direction transverse to the direction of travel of the model car in order to set the wheels 105 to a certain steering angle. The steering angle may vary in magnitude and/or direction during propulsion of the model car and during travel of the model car on the curved path.

The deflection mechanism 2 may also comprise more or less than the illustrated deflection gear wheels 203-209. The steering movement does not have to be symmetrical to the direction of travel of the model car when travelling straight ahead, but can also be asymmetrical thereto. In this case, the model car would turn more strongly and/or more often to one side than to the other side. Preferably, the steering movement of the steerable wheels 105 repeats periodically after a certain amount of time and/or a certain travel distance.

In the example shown in FIGS. 1-7, the spring mechanism 101 forms a unit with the rotational axis 201 of the rear wheels 102 of the model car. The axis 201 is rotatably mounted on a housing of the spring mechanism 101 or inside the housing. The rear wheels 102 are non-rotatably attached on the rotation axis 201. The housing of the spring mechanism 101 is directly or indirectly attached to the chassis 1 of the model car. The vehicle body may be attached to the housing of the spring mechanism 101 or to the chassis 1. The rear wheels 102 protrude into corresponding recesses or wheel housings of the vehicle body. The spring element of the spring mechanism 101 is arranged inside the housing. A proximal end of the spring element is attached to the housing while the other distal end of the spring element is attached to the axis of rotation 201, so that the spring element is tensioned by pulling back the model car standing on a surface and rotating the wheels 102 against the direction of travel when the model car is propelled. The tensioned spring element stores the energy used for the propulsion and the steering movement of the model car.

The axis of rotation 201 is—as said—guided by the housing of the spring mechanism 101. A first gear wheel 202 may be attached to the axis of rotation 201 in a rotationally fixed manner outside the housing. The gear wheel 202 transmits the rotational movement of the axis of rotation 201 to the deflection mechanism 2. This example (not shown) does not have an intermediate axle guided to the outside.

In an alternative example shown in FIGS. 1 and 2, the spring mechanism 101 has an outwardly directed intermediate axis 107 to which the distal end of the spring element is attached. The intermediate axis 107 protrudes from the housing of the spring mechanism 101 and is non-rotatably connected to a second gear 203 disposed outside the housing. The second gear 203 is in mesh with the first gear 202, which is non-rotatably mounted on the axis of rotation 201 of the rear wheels 102. At least one further gear wheel may also be arranged between the second gear wheel 203 and the first gear wheel 202, so that the rotational movement of the second gear wheel 203 is indirectly transmitted to the first gear wheel 202 via the further gear wheel or wheels. Instead of further gear wheels, a belt drive or a cardan shaft can also be provided between the intermediated axis 107 and the rotational axis 201. The further gear wheels, the belt drive or the cardan shaft would then form a transmission mechanism that transmits the rotational movement of the spring mechanism 101 (or the second gearwheel 203) to the axis of rotation 201 (or the first gearwheel 202). In this way, a step-up or step-down can be achieved between the rotational movement of the intermediate axis 107 and the rotational movement of the driven wheels 102 of the model car. Of course, one or more intermediate axes may also be provided in the housing of the spring mechanism 101.

In the example shown, the deflection mechanism 2 comprises a plurality of gear wheels 203-209, which may be of different sizes so that a step-up or step-down can be achieved between the rotational movement of the gears 202 or 203 and the steering movement of the steerable wheels 105. Alternatively or additionally, the deflection mechanism 2 may have a chain or belt drive and/or a drive shaft (e.g. in the manner of a cardan shaft). The deflection gear wheels 203-209 are arranged in a gear housing, which is not shown closed in the FIGS. In order to allow free view onto the deflection mechanism 2. The deflection mechanism 2 is driven by the gear wheel 202 or 203 arranged outside the housing of the spring mechanism 101. The rotary motion is transmitted forward to the output gear 209 or the deflection mechanism 2 via the deflection gear wheels 203-209 and/or a chain or belt drive and/or a drive shaft. The steering gear 3 converts the uniform or continuous rotary motion of the output wheel 209 into the approximately linear steering motion for the steerable wheels 105. The steering gear 3 may comprise one or more gear wheels 210, 211 and/or a cam gear (e.g. an oscillating gear), like the one shown in FIGS. 1 to 4C.

In the example shown in FIGS. 1-7, the steering gear 3 comprises an angular gear. The angular gear has an output gear wheel 211 whose surface extension is parallel to the steering movement of the steerable wheels 105 and preferably parallel to the surface on which the model car is standing during operation. The output gear wheel 211 is preferably formed as a ring gear wheel with an outer, upwardly projecting ring gear along the circumference. Furthermore, the angular gear comprises an input gear wheel 210 whose surface extension is perpendicular to the surface extension of the output gear wheel 211. The axes of rotation of the two gear wheels 210, 211 are preferably perpendicular to each other. The angular gear can also be designed as a bevel gear, for example.

The input gear wheel 210 is set into a rotary motion by the deflection mechanism 2 or by its output gear 209 and transmits this to the output gear wheel 211 of the angular gear. The energy for this comes—as said—from the tensioned spring mechanism 101. The input gear wheel 210 of the steering gear 3 can at the same time be the output gear wheel 209 of the deflection mechanism 2 or be arranged with it on a common axis in a rotationally fixed manner. Preferably, the input gear wheel 210 has a lower number of teeth than the output gear wheel 211, so that a reduction is achieved, the resulting steering movement being relatively slow and leisurely and the model car not moving left and right frantically during propulsion. In this way, a particularly realistic operation of the model car can be achieved.

The steering gear 3 and/or the steerable wheels 105 preferably have a return mechanism 106 which holds the steerable wheels 105 in a predefined steering angle, for example in a straight-ahead position, by means of spring force. The return mechanism 106 comprises, for example, a leaf spring, a spring clip or the like. Steering of the steerable wheels 105 takes place against the spring force of the return mechanism 106, thus ensuring that the steerable wheels 105 are aligned at the predefined steering angle, for example straight when there is no articulation of the steerable wheels 105 or when the steering function is deactivated by the coupling/decoupling mechanism 217.

The steerable wheels 105 are preferably articulated by means of a steering linkage 213 to ensure that both steerable wheels 105 are deflected in the same direction and by corresponding steering angles contemporarily. In addition, a deflection of the steerable wheels 105 can be effected by moving solely the steering linkage 213, a separate control of each steerable wheel 105 is not necessary. The steering linkage 213 can be linked to the steerable wheels 105 in such a way that during travel on a curved path, an inner wheel 105 is turned more than an outer wheel 105. The return mechanism 106 is preferably attached to the chassis 1 and acts on the steering linkage 213, for example via a pin 223 formed on the steering linkage 213 (cf. FIG. 1).

The steering axes 104 of the steerable wheels 105 run approximately vertically. They do not have to be exactly perpendicular to the surface on which the model car is standing, but may have a slight inclination inwards or outwards as well as forwards or backwards (in each case in relation to the model car). The steering axes 104 do not necessarily have to be exactly perpendicular to the axes of rotation 201 of the steerable wheels 105.

The steering linkage 213 is guided for longitudinal movement on the chassis 1 and/or vehicle body in a direction transverse to the direction of travel of the model car when travelling straight ahead. The steering gear 3 may comprise an eccentric mechanism in direct or indirect contact with the steering gear wheels 210, 211. In the first embodiment of FIGS. 1-3A, the eccentric mechanism comprises a projection 212 eccentrically arranged on the output gear wheel 211 in the form of a pin and a corresponding opening 214 in which the projection 212 engages. The projection 212 is associated with the steering gear 3 or the output gear wheel 211 and the opening 214 is associated with the steering linkage 213. The opening 214 of the steering linkage 213 preferably has an elongated shape, particularly preferably having a longitudinal extension perpendicular to the direction of the steering movement and parallel to the direction of travel when driving straight ahead.

In the embodiment example of FIGS. 3B-4C, the eccentric mechanism has a three-pronged star 215 with three eccentric recesses 216 formed between the prongs. The three-pronged star 215 is non-rotatably formed on the upper side of the output gear wheel 211. In this respect, the axis of rotation of the star 215 preferably coincides with the axis of rotation of the output gear wheel 211. Of course, the star 215 could also be arranged eccentrically to the output gear wheel 211 so that the axes of rotation would be spaced apart. The side edges of the prongs of the star 215 may be convexly outwardly curved.

Two peg-shaped projections 212 of the eccentric mechanism are formed on the underside of the steering linkage 213 and project into the eccentric recesses 216 of the star 215. The rotational movement of the output gear wheel 211 causes the projections 212 to pass from one recess 216 to the next, thereby imparting a periodic steering movement to the steering linkage 213 and thus articulating the steerable wheels 105 (cf. FIGS. 4A-4C). In the example, a guide pin 228 extends upwards in the region of an axis of rotation of the output gear wheel 211 or the star 215, which engages in a guide opening 227 formed in the steering linkage 213 and thus guides the steering linkage 213 in the essentially linear steering movement, in particular transversely to the direction of travel of the model car when driving straight ahead.

Figure 4A:
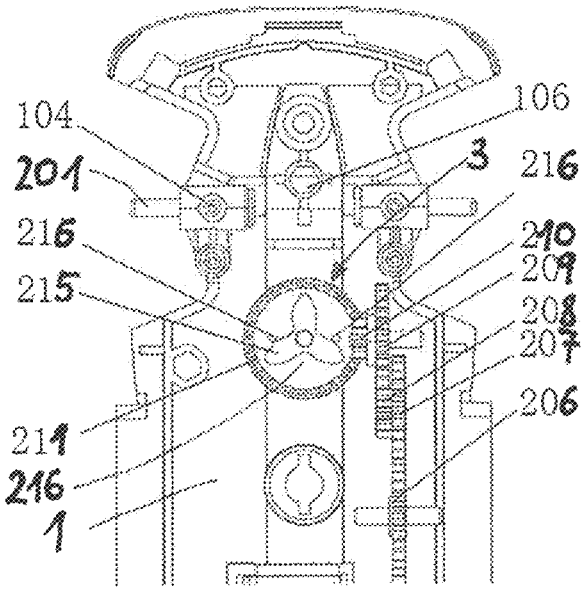
FIGS. 4A-4C are top views on the front part of the model car of FIG. 1.
Figure 4B:
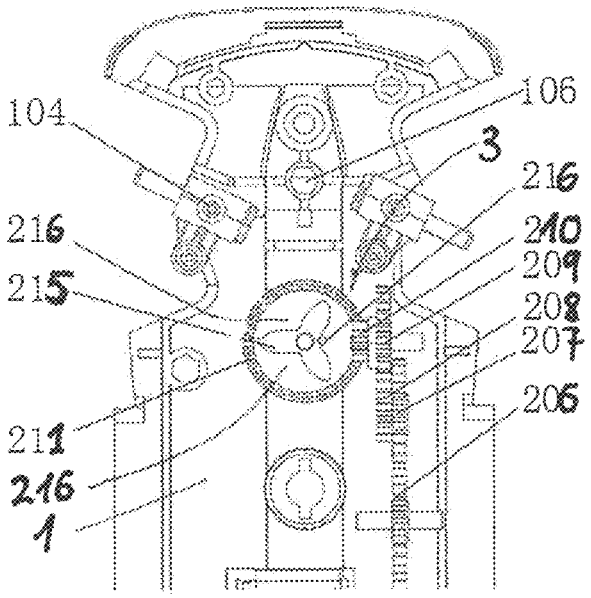
Figure 4C:
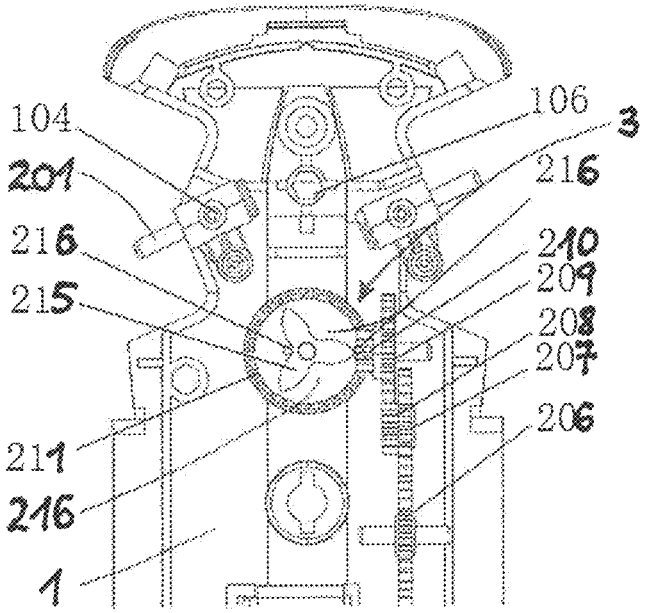
Figure 5A:
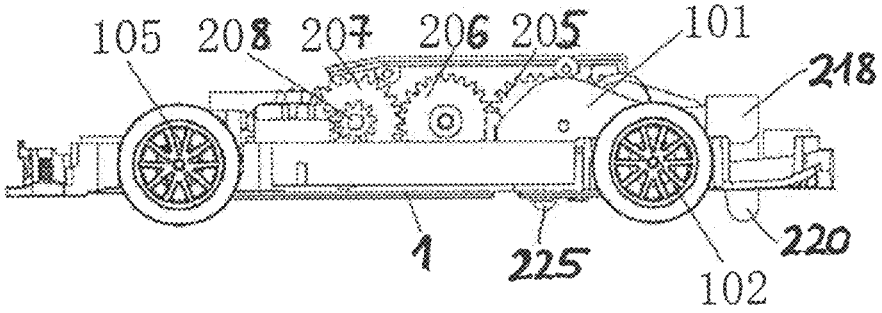
FIGS. 5A and 5B is a side view and a bottom view on the model car of FIG. 1.
Figure 5B:
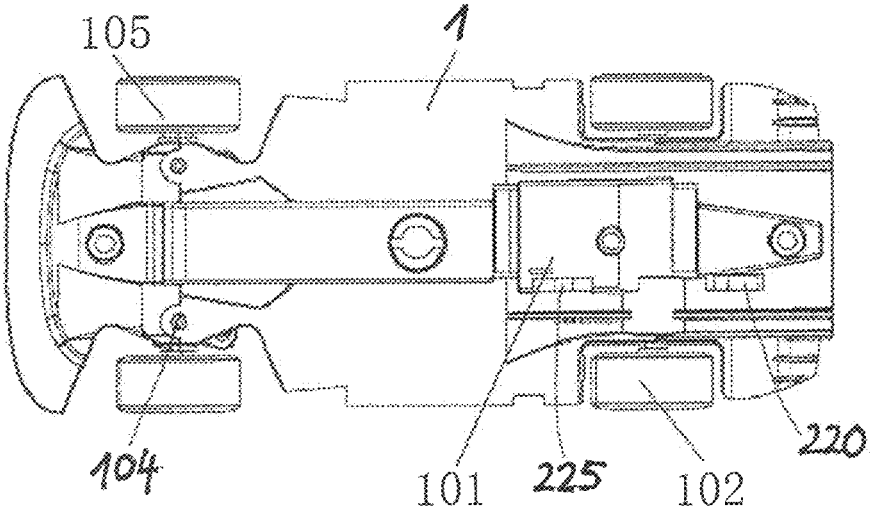

FIG. 4A shows the position of the steering linkage 213 or the pivots 212 when driving straight ahead, FIG. 4B shows the position of the pivots 212 when driving through a bend to the right and FIG. 4C shows the position of the pivots 212 when driving through a bend to the left. Depending on the arrangement of the pivots 212 on the steering linkage 213, the steering movement can be symmetrical or asymmetrical to the direction of travel of the model car when driving straight ahead. For clarity, the steering linkage 213 is not shown in FIGS. 4A-4C.

By changing the eccentric mechanism and by varying the eccentric (distance from the axis of rotation of the output gear wheel 211) of the pivot(s) 212 or the recess 216 or opening 214, the type and degree of steering movement can be changed. Depending on the eccentric mechanism, this can be symmetrical (equal on both sides) or asymmetrical (unequal on both sides) to the direction of travel when driving straight ahead. Likewise, the degree of steering movement (maximum steering angle) to one side and the other can be different.

Functionally, the coupling/decoupling mechanism 217 can be provided between the spring mechanism 101 and the steering gear 3. The coupling/decoupling mechanism 217 can be actuated from outside the model car (cf. FIGS. 6 and 7), by the actuation of which the steering function of the steerable wheels 105 can be activated or deactivated during propulsion of the model car. When the steering function is deactivated (cf. FIG. 7), the model car according to the invention can drive straight ahead as normal or on a fixed, preset circular path. When the steering function is activated (cf. FIG. 6), the model car travels—as described above—on a—possibly dynamically varying—curved path during propulsion.

Figure 6:
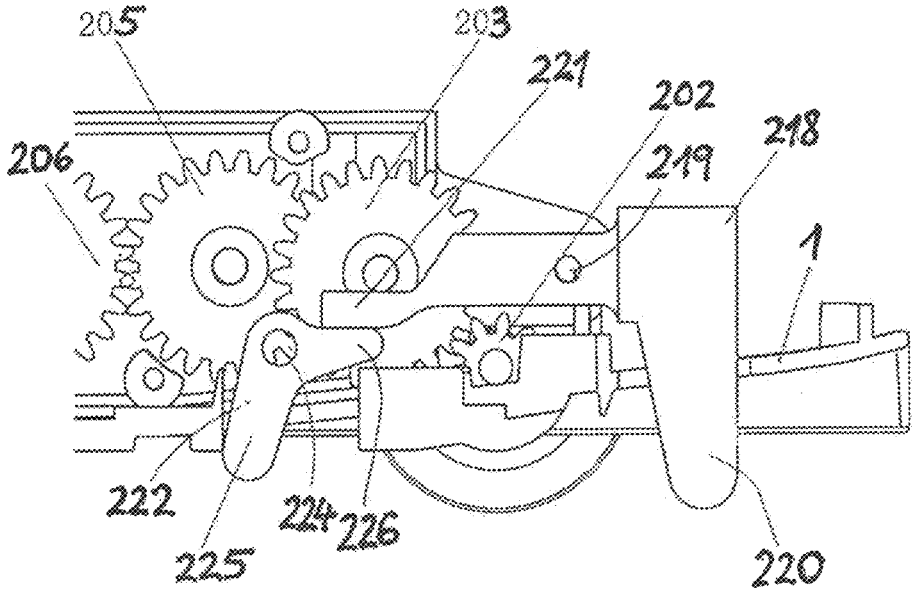
FIG. 6 is side view on a coupling/decoupling mechanism of the model car of FIG. 1 in a first position.
Figure 7:
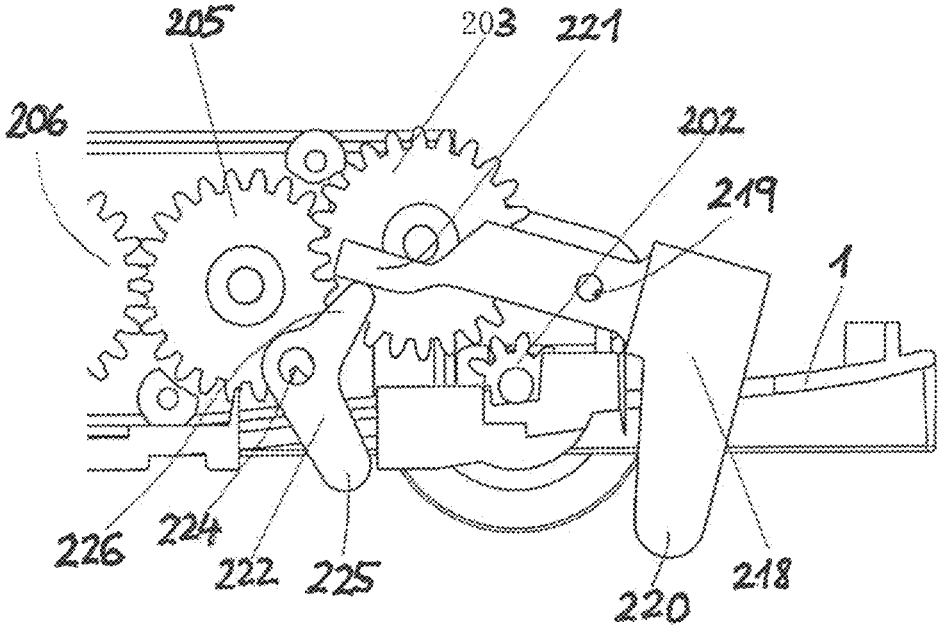
FIG. 7 is side view on the coupling/decoupling mechanism of FIG. 6 in a second position.

In the example of FIGS. 6 and 7, when the steering function is deactivated (cf. FIG. 7), a gear wheel 203 of the deflection mechanism 2, which is in engagement with the first gear wheel 202 of the spring mechanism 101 directly or indirectly via one or more further gear wheels, is separated from the first gear wheel 202, so that the gear wheels 202, 203 are no longer in mutual engagement and the continuous rotary movement of the first gear wheel 202 is only transmitted to the axis of rotation 201 for propulsion of the model car and no longer to the deflection gear wheels 203-209 of the deflection mechanism 2.

For actuating the coupling/decoupling mechanism 217, a lever 218, preferably in the form of a bell crank, is provided which is pivotably mounted on the chassis 1 of the model car at a pivot 219. A first end 221 of the lever 218 abuts the rotational axis of the gear 203 from below. An opposite end 220 of the lever 218 may form a counterweight to the weight of the gear 203. When the lever 218 is actuated (cf. FIG. 7), the first end 221 of the lever 218 lifts the gear wheel 203 of the deflection gear wheels 203-209 and disengages the gear wheel 202 so that the steering function is disabled. When the lever 218 is not actuated (cf. FIG. 6), the gear wheel 203 of the deflection gear wheels 203-209 falls down again due to gravity or spring force and engages with the gear wheel 202 so that the steering function is activated. The counterweight of the second end 220 of the lever 218 can dampen the movement of the gear wheel 203 from the decoupled position (cf. FIG. 7) to the coupled position (cf. FIG. 6).

For actuating the lever 218, a further lever 222, preferably in the form of a bell crank, is provided which is mounted on the chassis 1 so as to be pivotable about an axis of rotation 224. An actuating portion 225 at a first end of the further lever 222 is actuatable from outside the vehicle. Preferably, the actuating portion 225 is located on the underside of the model car and projects outwardly from the model car through a corresponding opening in the chassis 1. An effective portion 226 opposite the actuating portion 225 abuts the underside of the first end 221 of the lever 218. Actuation (movement from left to right in FIGS. 6 and 7) of the further lever 222 by means of the actuating portion 225 raises the effective portion 226 and thus also the first end 221 of the lever 218 and finally also the gear wheel 203 and disengages the engagement between the two gear wheels 202, 203. By means of the further lever 222, the coupling/decoupling mechanism 217 is self-locking, i.e. it remains automatically in the set position.

Alternatively, even when the steering function is deactivated (cf. FIG. 7), the coupling/decoupling mechanism can, for example separate the input gear wheel 210 and the output gear wheel 211 of the steering gear 3 from each other, so that they are no longer in mutual engagement and the continuous rotational movement of the output gear wheel 209 of the deflection gear wheels 203-209 is no longer transmitted to the steering linkage 213 and further to the steerable wheels 105 (not shown). If such a coupling/decoupling mechanism is in the decoupled state, the output gear wheel 211 is moved downwards and thus separated from the input gear wheel 210. Rotation of the input gear wheel 210 is thus not transmitted to the output gear wheel 211 and hence to the steering linkage 213 and the steerable wheels 105.

If such a coupling/decoupling mechanism is in the decoupled state, is in the coupled state, the output gear wheel 211 is raised relative to the position described in the previous paragraph and thus in engagement with the input gear wheel 210. In this state, rotation of the input gear wheel 210 is transmitted to the output gear wheel 211 and thus to the steering linkage 213 and the steerable wheels 105. To disengage the mechanism or deactivate the steering function, the mechanism may be rotated about an axis of rotation that extends substantially perpendicular to the surface on which the model car is standing. The mechanism may have rising ramps which—depending on the direction of rotation of the mechanism—raise or lower the output gear wheel 211 in a direction parallel to the axis of rotation of the alternative coupling/decoupling mechanism.

Figure 8:
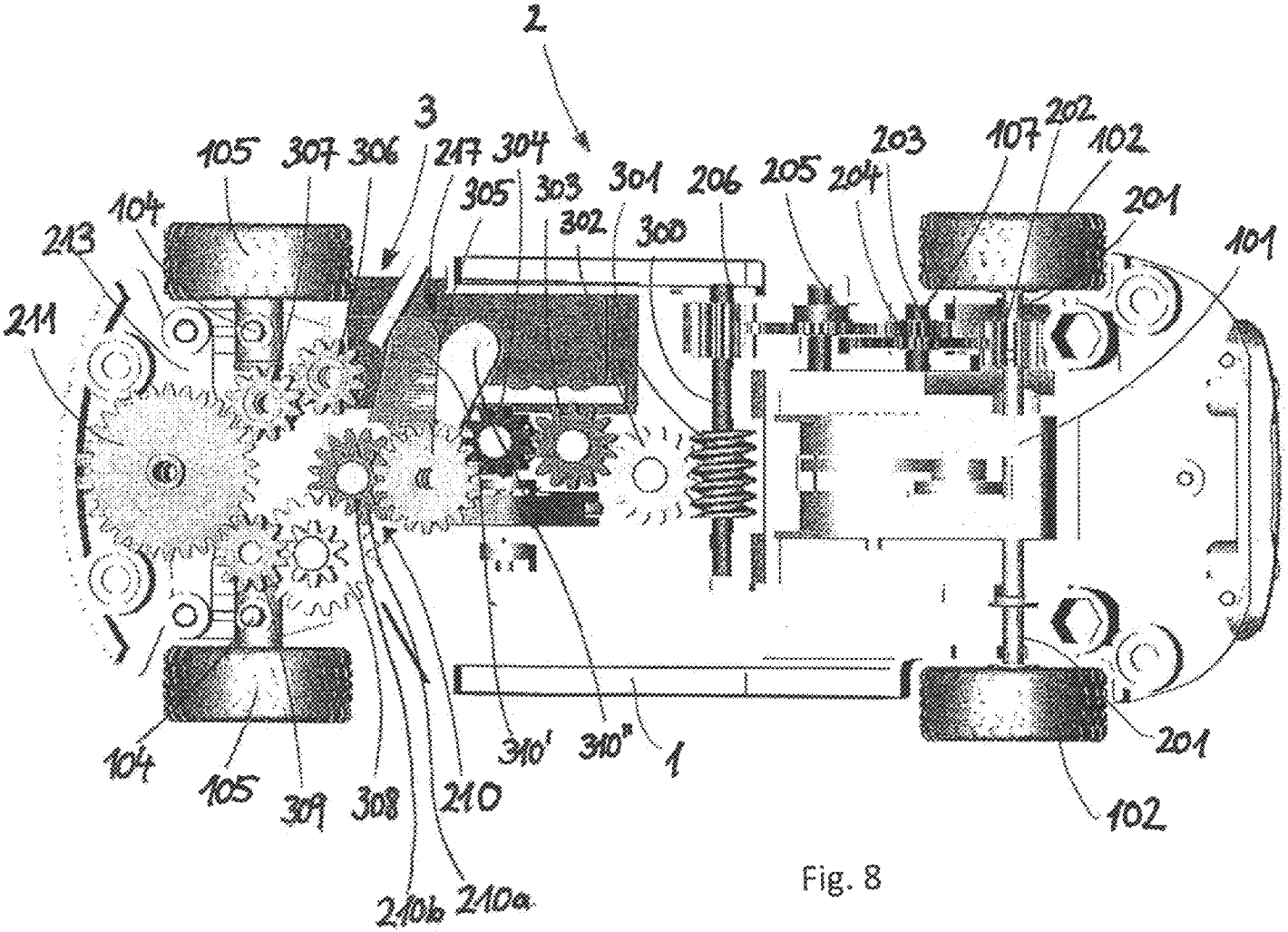
FIG. 8 is a top view on a model car according to another embodiment of the present invention, with a vehicle body separated from a vehicle chassis.

According to another embodiment of the invention shown in FIG. 8, deflection mechanism 2 comprises the meshing gear wheels 203-206. The gear wheel 206 is attached to a rotational axis 300 in a torque proof manner. Also attached to the rotational axis 300 is a worm 301 of a worm wheel gear. The worm meshes with another gear wheel 302, which in turn meshes with further gear wheels 303, 304, 305. The gear wheel 305 constitutes a final gear wheel of the deflection mechanism 2.

In the embodiment of FIG. 8, the steering gear 3 comprises a plurality of gear wheels including an input gear wheel 210 operatively connected to the spring mechanism 101, in the shown embodiment by means of the deflection mechanism 2, and an output gear wheel 211 operatively connected to the steering linkage 213 and the at least one steerable wheel 105, respectively. The input gear wheel 210 is movable about a rotational axis about the final gear wheel 305 of the deflection mechanism 2.

Furthermore, the steering gear 3 of FIG. 8 comprises two intermediate gear wheel paths for providing an operative connection between the input gear wheel 210 and the output gear wheel 211 on alternative gear wheel paths. A first gear wheel path comprises meshing intermediate gear wheels 306 and 307. The first intermediate gear wheel 306 is adapted to mesh with the input gear wheel 210 if it is moved into a respective position (i.e. moved upwards in FIG. 8). The second intermediate gear wheel 307 of the first gear wheel path meshes with the output gear wheel 211 at a first predefined section. A second gear wheel path comprises intermediate gear wheels 308, 309. The first intermediate gear wheel 308 is adapted to mesh with the input gear wheel 210 if it is in a respective position (i.e. the position shown in FIG. 8). The second intermediate gear wheel 309 of the second gear wheel path meshes with the output gear wheel 211 at a second predefined section, circumferentially displaced form the first section.

Movement of the input gear wheel 210 about the rotational axis of the final gear wheel 305 of the deflection mechanism 2 may effected by means of the coupling/decoupling mechanism 217. By moving the input gear wheel 210 it can selectively mesh with an intermediate gear wheel 306 of the first intermediate gear wheel path, with an intermediate gear wheel 308 of the second intermediate gear wheel path, or with no intermediate gear wheel (i.e. positioned between the two intermediate gear wheels 306, 308). Movement of the input gear wheel 210 about the rotational axis of the final gear wheel 305 of the deflection mechanism 2 assures that the input gear wheel 210 is always in meshing contact with the final gear wheel 305 irrespective of movement position of the input gear wheel 210.

The coupling/decoupling mechanism 217 may comprise a lever 310 with is operable, preferably manually by a user of the model car, from outside the model car, i.e. from outside the chassis 1 and the vehicle body. A position of the lever 310 corresponding to the positon of the input gear wheel 210 shown in FIG. 8 (meshing with the second intermediate gear wheel path 308, 309) is indicated with reference sign 310'. An alternative position of the lever 310 corresponding to a positon of the input gear wheel 210 when meshing with the first intermediate gear wheel path 306, 307 (not shown in FIG. 8) is indicated with reference sign 310".

For instance, when the input gear wheel 210 meshes with an intermediate gear wheel 306 of the first intermediate gear wheel path 306, 307, the model car may be made to travel on an S-shaped path. When the input gear wheel 210 meshes with an intermediate gear wheel 308 of the second intermediate gear wheel path 308, 309, the model car may be made to travel on an 8-shaped path. When the input gear wheel 210 meshes with none of the intermediate gear wheels 306, 308, the model car may be made to travel on a straight path.

Of course, other embodiments of the steering gear 3 are also conceivable in order to switch the travel of the model car between a straight path and a curved path and/or between two or more types of curved paths, e.g. S-shaped and 8-shaped paths.

It is suggested that the input gear wheel 210 comprises two coaxially arranged pinions 210*a* and 210*b* with different numbers of teeth fixed to each other so that they cannot rotate in respect to each other about a rotational axis of the input gear wheel 210. A first pinion 210*a* of the input gear wheel 210 is configured to mesh with the intermediate gear wheel 306 of the first intermediate gear wheel path 306, 307 and a second pinion 210*b* of the input gear wheel 210 is configured to mesh with the intermediate gear wheel 308 of the second intermediate gear wheel path 308, 309.

This can have the effect that the steering speed, i.e. the rate of change of the model car's direction, is different when travelling on an S-shaped path than when travelling on an 8-shaped path.

It is emphasized that one or more of the intermediate gear wheels 306-309 may also comprise two coaxially arranged pinions with different numbers of teeth fixed to each other so that they cannot rotate in respect to each other about a rotational axis of the respective intermediate gear wheel (see for instance intermediate gear wheel 308). Furthermore, it is emphasized that it will be immediately apparent to the skilled person that the steering gear 3 can be designed differently from what is shown in FIG. 8, thereby still solving the object of the present invention.

Finally, it is suggested that the output gear wheel 211 of the steering gear 3 eccentrically drives the steering linkage 213 which is articulated to the at least one steerable wheel 105. Preferably, the model car comprises a total of four wheels 102, 105, wherein the two front wheels 105 are steerable and the two rear wheels 102 are the driven wheels. The steering linkage 213 connects the two steerable wheels 105 and provides for contemporary articulation of both front wheels 105. Continuous rotation of the output gear wheel 211 in a given direction preferably provokes a continuous back and forth movement of the steering linkage 213 (preferably in a direction approximately perpendicular to the longitudinal extension of the model car and to the driving direction) and consequently to a continuously repeating left and right articulation of the steerable wheels 105. Depending on how long the articulation of the steerable wheels 105 in a given direction lasts, the model car will travel on an S-shaped path, on an 8-shaped path or on any other kind of curved path.

I claim:

1. A model car configured to travel on at least two different paths including one path and at least one other path, the model car comprising a) a car chassis (1) having at least three wheels (102, 105) rotatably mounted thereto and a tensionable spring mechanism (101) in a rotary connection to at least one drivable wheel (102) of said at least three wheels (102, 105) for driving said at least one drivable wheel (102), wherein the energy stored in said tensionable spring mechanism (101) is used to drive said at least one drivable wheel (102) and to propel said model car standing on a surface, b) at least one steerable wheel (105) of said at least three wheels (102, 105) embodied as a steerable wheel articulated in respect to the car chassis (1) about a steering axis (104), wherein articulation of the at least one steerable wheel (105) is effected by means of a steering gear (3), c) a deflection mechanism (2) which is operatively connected to the spring mechanism (101) in such a way that part of the energy stored in the tensionable spring mechanism (101) is used to steer the at least one steerable wheel (105) during propulsion of the model car, and d) a coupling/decoupling mechanism (217) operable from outside the model car, functionally arranged between the tensionable spring mechanism (101) and the steering gear (3) and configured to switch a steering function of the at least one steerable wheel (105) thereby switching travel of the model car between the at least two different paths, including switching travel of the model car from the one path to the at least one other path, and switching travel of the model car from the at least one other path to the one path, wherein the steering gear (3) comprises a plurality of gear wheels including an input gear wheel (210) operatively connected to the spring mechanism (101), an output gear wheel (211) operatively connected to the at least one steerable wheel (105), and two intermediate gear wheel paths each comprising at least one intermediate gear wheel (306, 307; 308, 309) providing an operative connection between the input gear wheel (210) and the output gear wheel (211) on alternative intermediate paths, and the input gear wheel (210) is movable by means of the coupling/decoupling mechanism (217) in order to selectively mesh with at least two intermediate gear wheels (306, 307; 308, 309), including either meshing with a first of an intermediate gear wheel (306) of a first intermediate gear wheel path, or meshing with a second intermediate gear wheel (308) of a second intermediate gear wheel path, or not meshing with any intermediate gear wheel at all.

2. The model car according to claim 1, wherein the at least two different paths comprise either a straight path and at least one curved path, or at least two curved paths.

3. The model car according to claim 2, wherein the at least one curved path comprises at least one of an S-line path and a path formed as a FIG. 8.

4. The model car according to claim 3, wherein the at least one curved path comprises the S-line path and the path formed as the FIG. 8, and the coupling/decoupling mechanism (217) is configured to switch travel of the model car to one of a straight path, the S line path and the path formed as the FIG. 8.

5. The model car according to claim 1, wherein the at least two different paths comprise a straight path and at least one curved path; and the coupling/decoupling mechanism (217) is configured to deactivate or activate a steering function of the at least one steerable wheel (105).

6. The model car according to claim 5, wherein the steering gear (3) is switchable between different configurations, including a first configuration in which the at least one steerable wheel (105) is not articulated about the steering axis (104) so as to make the model car travel on a straight path and at least one second configuration in which the at least one steerable wheel (105) is articulated so as to make the model car travel on the at least one curved path.

7. The model car according to claim 6, wherein the at least one second configuration comprises different subconfigurations, including a first sub-configuration in which the at least one steerable wheel (105) is articulated so as to make the model car travel on an S-line path and a second subconfiguration in which the at least one steerable wheel (105) is articulated so as to make the model car travel on a path having the form of a FIG. 8.

8. The model car according to claim 7, wherein the coupling/decoupling mechanism (217) is configured to switch the steering gear (3) between the different configurations and the different sub-configurations.

9. The model car according to claim 6, wherein the coupling/decoupling mechanism (217) is configured to switch the steering gear (3) between the different configurations.

10. The model car according to claim 1, wherein the model car is designed as a pull-back model car or a wind-up model car.

11. The model car according to claim 1, wherein the input gear wheel (210) comprises two coaxially arranged pinions (210*a*, 210*b*), each coaxially arranged pinion (210*a*, 210*b*) having a different number of teeth and being fixed to each other so that the two coaxially arranged pinions (210*a*, 210*b*) cannot rotate in respect to each other about a rotational axis of the input gear wheel (210), the two coaxially arranged pinions (210*a*, 210*b*) having a first pinion (210*a*) configured to mesh with the first intermediate gear wheel (306) of the first intermediate gear wheel path, and having a second pinion (210*b*) configured to mesh with the second intermediate gear wheel (308) of the second intermediate gear wheel path.

12. The model car according to claim 1, wherein the output gear wheel (211) eccentrically drives a steering linkage (213) which is articulated to the at least one steerable wheel (105).

* * * * *